US005648144A

United States Patent [19]

Maurer et al.

[11] Patent Number: 5,648,144

[45] Date of Patent: Jul. 15, 1997

[54] SYNTHETIC SLATE ROOFING MEMBER

[76] Inventors: Ronald L. Maurer, 5697 N. Pennsylvania St., Indianapolis, Ind. 46220; Frank C. Cosmas, 6214 Northwood Dr., Carmel, Ind. 46033

[21] Appl. No.: 721,752

[22] Filed: Sep. 30, 1996

Related U.S. Application Data

[63] Continuation of Ser. No. 314,055, Sep. 28, 1994, abandoned.

[51] Int. Cl.[6] ..... E04D 1/14; E04D 1/20

[52] U.S. Cl. ..... 428/141; 428/156; 428/131; 428/192; 428/313.3; 428/15; 52/518; 52/555; 52/554

[58] Field of Search ..... 428/141, 156, 428/131, 192, 313.3, 15; 52/518, 555, 554

[56] References Cited

U.S. PATENT DOCUMENTS

| | | | |
|---|---|---|---|
| 3,593,479 | 7/1971 | Hinds | 52/531 |
| 4,028,450 | 6/1977 | Gould | 264/45.5 |
| 4,191,722 | 3/1980 | Gould | 264/45.5 |
| 4,226,070 | 10/1980 | Aragon | 52/57 |
| 4,307,552 | 12/1981 | Votte | 52/309.13 |
| 4,366,197 | 12/1982 | Hanlon et al. | 428/43 |
| 4,473,673 | 9/1984 | Williams et al. | 523/318 |
| 4,864,793 | 9/1989 | Miyazaki | 52/54 |
| 4,966,794 | 10/1990 | Hasegawa et al. | 428/15 |
| 5,053,274 | 10/1991 | Jonas | 428/332 |
| 5,063,093 | 11/1991 | Mentzer | 428/15 |
| 5,072,562 | 12/1991 | Crick et al. | 52/533 |
| 5,094,058 | 3/1992 | Slocum | 52/533 |
| 5,287,669 | 2/1994 | Hannah et al. | 52/518 |
| 5,359,817 | 11/1994 | Fulyon | 52/288.1 |
| 5,376,721 | 12/1994 | McGarry et al. | 525/64 |

*Primary Examiner*—William Watkins
*Attorney, Agent, or Firm*—Brinks Hofer Gilson & Lione

[57] ABSTRACT

A synthetic slate roofing member composed of solid surfacing material and configured to realistically resemble the appearance and texture of natural slate while being lighter in weight, more durable and less costly than natural slate. The solid surfacing material preferably incorporates various additives and fillers to enhance the physical properties and appearance of the member.

10 Claims, 2 Drawing Sheets

SYNTHETIC SLATE ROOFING MEMBER

This application is a continuation of application Ser. No. 08/314,055, filed Sep. 28, 1994, abandoned.

BACKGROUND OF THE INVENTION

1. Field of the Invention

The present invention relates generally to a synthetic member for roofing and other applications; and, more particularly, to a roofing member composed of solid surfacing material which realistically resembles natural slate while being lighter in weight, more durable and less costly than slate.

2. Description of the Prior Art

Natural slate has long been a popular roofing material due to its attractive appearance and durability and also because it possesses other highly desirable properties such as being fireproof and waterproof. Natural slate, however, is also very expensive; and, as a result, is normally used for roofing in only the most expensive of houses and in other structures where the increased cost can be justified.

Furthermore, natural slate is also quite heavy and, therefore, it is often necessary to build-up or otherwise strengthen the roof structure onto which the slate is to be laid, and this further increases the overall cost of the house or other structure.

Slate is also a rather brittle material, and can be cracked or broken rather easily. When this occurs, it often becomes necessary to replace the broken slate in its entirety.

In addition, although considered to be a durable roofing material, slate does deteriorate over time, particularly at its edges, as a result of water entering between the layers of the slate; and, after a period of time, for example, 50–60 years, replacement becomes necessary.

Recognizing the insufficiencies of slate as well as of other natural roofing materials, the use of man-made materials, primarily asphalt-based materials, has become increasingly popular for roofing applications.

Significant effort has also gone into adapting plastic materials for the roofing industry. For example, it is known to form roofing materials from large plastic sheets or from polystyrene and polyethylene foam. Attempts have also been made to develop synthetic roofing members that will provide the appearance of natural slate (see for example, U.S. Pat. No. 4,307,552).

Although synthetic roofing materials provide advantages of being moldable, light in weight and relatively inexpensive; they have not, in general, been fully satisfactory because they often lack the necessary durability for roofing applications and usually are not sufficiently realistic in appearance to be acceptable in the marketplace.

BRIEF DESCRIPTION OF THE INVENTION

The present invention provides a synthetic member that is waterproof, fire-retardant and highly durable; and that can be easily manufactured in a form that very realistically resembles slate and other natural materials commonly using in roofing, siding and other applications.

A synthetic roofing member according to the present invention comprises a molded body composed of solid surfacing material and having the appearance, texture and "feel" of natural slate including edges whose thickness decreases in irregular steps in the manner of natural slate.

Solid surfacing material possesses numerous properties which makes it especially suitable as a roofing material including being non-porous and thus highly waterproof, fire-retardant and extremely durable. Solid surfacing material also has chemical resistance, stain resistance and a high degree of repairability.

A synthetic slate roofing member according to the present invention can be provided in essentially any color found in natural slate including the color of red slate which is extremely rare and expensive; or in any other desired color. The surface thereof is also capable of being brushed or otherwise treated in the same manner as natural slate for highlighting or for otherwise enhancing its appearance.

According to a presently preferred embodiment, various additives or filler materials are incorporated into the solid surfacing material formulation to enhance the properties of the member as a roofing material. For example, a lightweight filler material is preferably added as a weight-reducing agent to reduce the weight of the members to a weight of about 30 percent less than that of natural slate. Also, a suitable inhibitor or the like is preferably added to the formulation to increase the flexibility or resiliency of the solid surfacing material somewhat so that it is better able to resist chipping or cracking due to impact.

An important aspect of the present invention is that the roofing members are capable of being easily repaired in place on a roof. In particular, a chip or crack in the member can readily be repaired by filling in the chip or crack utilizing conventional solid surfacing repair materials. This is an important advantage over natural slate which must usually be replaced in its entirety when it cracks.

Further, because the roofing member of the present invention is a solid molded component, there are no layers between which water can enter; and, thus, the member will not deteriorate in the manner of natural slate. It is believed, in fact, that roofing members according to the present invention will retain their integrity for 100 years or more.

Synthetic slate roofing members according to the present invention are also designed to be handled and laid in the same manner as natural slate utilizing the same hardware, tools and procedures, and thus its use does not require any specialized training or unusual equipment.

Further advantages and specific details of the present invention will become apparent hereinafter in conjunction with the following detailed description of presently preferred embodiments.

DETAILED DESCRIPTION OF THE PREFERRED EMBODIMENTS

Figure 1:
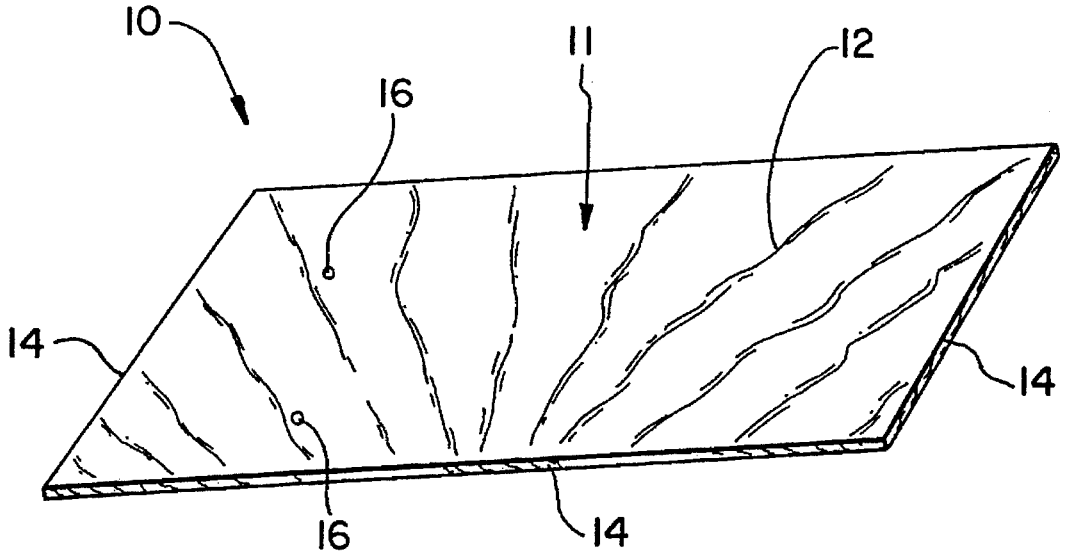
FIG. 1 schematically illustrates a synthetic slate roofing member according to a presently preferred embodiment of the invention.

FIG. 1 schematically illustrates a synthetic slate roofing member according to a presently preferred embodiment of the invention. The roofing member is generally designated by reference number 10 and comprises a generally flat, substantially rectangular-shaped member having any desirable dimensions appropriate for roofing applications. In a presently preferred embodiment, for example, the member has lateral dimensions of 12 inches by 20 inches and has a thickness of from about one-quarter inch to about one-half inch which is a common size for natural slate roofing. As illustrated by the irregular lines 12 in the Figure, the surface 11 of the member 10 is also provided with an irregular pattern and texture thereon which is substantially identical to that of natural slate; and, in addition, has edges 14 in which the thickness thereof decreases in a series of irregular steps in a manner similar to natural slate.

Member 10, however, is not natural slate, but is formulated entirely of synthetic materials in such a manner as to provide not only the appearance, texture and "feel" of slate, but also the desirable properties of slate including being waterproof and fire-retardant. At the same time, the synthetic slate roofing member of the present invention is lighter in weight and less expensive than natural slate and even more durable than natural slate.

According to the present invention, roofing member 10 comprises a body composed of solid surfacing material which is molded so as to very closely resemble the appearance of natural slate.

A solid surfacing material is generally recognized in the industry as comprising a product which is cast or extruded, which is colored throughout, and is 98 percent or more de-aired, utilizing a matrix consisting of a resin (for example, polyester, acrylic or a combination thereof) and inert fillers, most commonly aluminum trihydrate (ATH) which functions as an extender for the resin and which renders the resin fire-retardant.

Solid surfacing materials are available in the marketplace from various sources, for example, under the trademark CENTURA available from Centura Solid Surfacing, Inc. of Indianapolis, Ind. and under the trademark CORIAN available from duPont; and, accordingly, details of its manufacture need not be recited herein in any substantial detail. CENTURA is a rigid, de-aired solid surfacing material composed primarily of a thermoset polyester component. CORIAN is substantially rigid, non-foamed, non-laminated or coated solid surfacing material composed primarily of thermoset acrylic components. In general, a solid surfacing material may be manufactured by mixing an unsaturated polyester resin with aluminum trihydrate of the appropriate particle size. Appropriate additives and colorants may also be added to the mix, depending on the particular application in which the finished article is to be used. The mix is then homogenized in a vacuum mixer forcing air from the product so that the product is 98 percent or better de-aired. After a short mixing cycle, the mix is then transferred into a mold and molded at room temperature; and, when ready, the molded article is demolded and finished as appropriate. The resultant article is highly chemical-resistant, stain-resistant and repairable and can be tooled into many shapes and designs using common woodworking tools. Because it is a fully densified product, it has a non-porous surface and this property together with its being fire-retardant makes the article particularly suitable for use as a roofing material.

A synthetic slate roofing member according to the present invention is preferably molded in an open-faced cavity having a negative draft to permit proper molding of the stepped edges of the member, and the mold is preferably formed of silicone rubber or other deformable material to facilitate removal of the member from the mold after completion of the molding process. Preferably also, the mold is designed to form appropriate holes (illustrated at 16 in FIG. 1) in the member 10 for receipt of mounting nails, although the holes can also be formed by drilling through the finished product, if desired.

After removal from the mold, the member 10 can be sanded and/or otherwise finished as desired for a particular application. For example, the surface 11 thereof can be brushed in a manner similar to natural slate so as to highlight the pattern thereon.

In accordance with the present invention, various additives and fillers are preferably added to the solid surfacing material formulation to enhance its properties and characteristics. For example, as indicated above, colorants are preferably added to duplicate the colors of natural slate including expensive red slate. Member 10 can, of course, also be provided in colors different from those found in natural slate, if desired.

Also, a lightweight filler is preferably added to the formulation to function as a weight-reducing agent to reduce the weight of member 10. In the presently preferred embodiment, a suitable weight-reducing agent comprises a quantity of hollow microspheres or another commercially available weight-reducing agent. In a presently most preferred embodiment, a synthetic slate roofing member according to the invention comprises about 40 percent by weight of polyester resin, about 50 percent by weight of aluminum trihydrate and about 10 percent by weight of hollow microspheres to provide a roofing member that is about 30 percent lighter in weight than natural slate.

Because it is lighter in weight than natural slate, member 10 is easier to transport and handle, and, in addition, it is usually not necessary to strengthen or otherwise reinforce the roof structure onto which the members are to be laid as is often the case with natural slate.

Preferably also, a small amount of an additive such as an inhibitor is added to the formulation to increase the resiliency of the member 10 somewhat so as to enable it to better withstand impacts without chipping or cracking. In a presently preferred embodiment, such inhibitor comprises a quinone inhibitor, and most preferably, toluhydroquinone, which functions to prevent a 100 percent cure of the solid surfacing material and thus renders the member somewhat more flexible or resilient.

An important aspect of the synthetic slate roofing member of the present invention is that it is readily repairable. With natural slate, when a crack or break occurs, it is usually necessary to remove and replace the entire slate. With the present invention, cracks and chips can easily be repaired on the roof without removing the damaged member by utilizing conventional solid surfacing repair materials which greatly facilitates its maintenance.

Also, because the roofing member of the present invention is a solid, molded product, there is no place for water to enter and cause deterioration as is the case in natural slate. Thus, the roofing member of the present invention is even more durable than slate; and, it is believed, will retain its integrity for 100 years or more.

Figure 2:
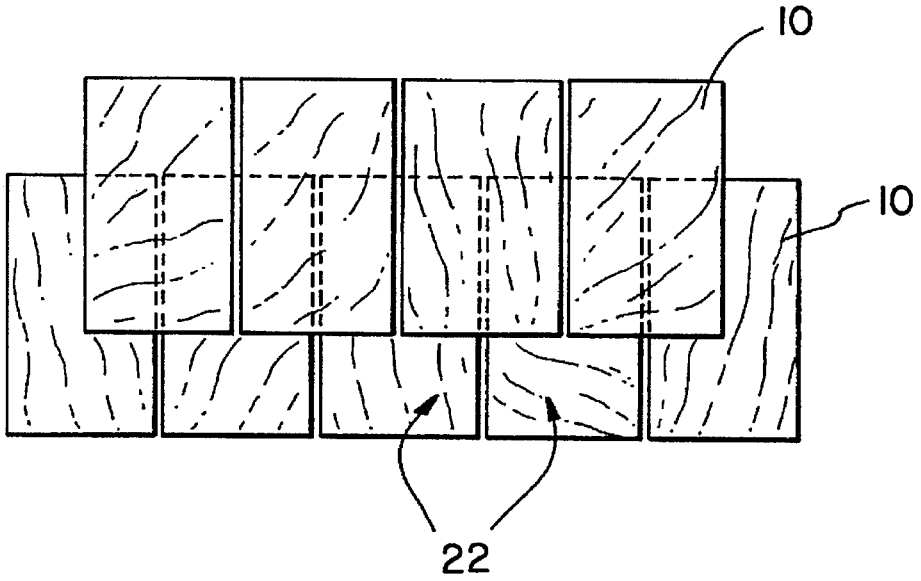
FIG. 2 schematically illustrates an arrangement for laying the roofing members of FIG. 1.

FIG. 2 illustrates one arrangement for laying roofing members 10 as shown in FIG. 1. As illustrated, the roofing members 10 can be laid in an alternating overlapping manner in a configuration similar to that used with natural slate and to have an exposure portion 22 substantially identical to that of natural slate so that, when laid, the roofing members of the present invention will appear identical to a slate roof. The synthetic roofing members of the invention can also be laid utilizing conventional hardware, tools and procedures as are used in the laying of natural slate.

Figure 3:
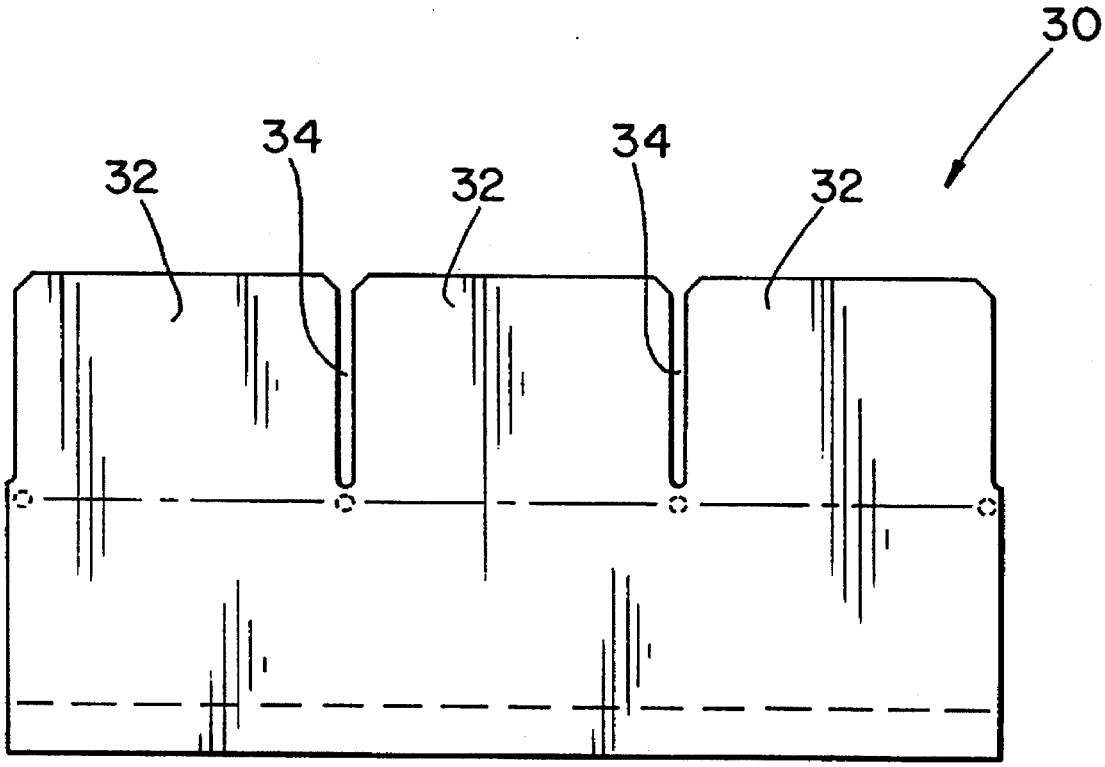
FIG. 3 illustrates a synthetic slate roofing member according to an alternative embodiment of the present invention.

FIG. 3 illustrates an alternative embodiment of the present invention. In FIG. 3, the synthetic roofing member is molded into the form of a shingle 30 having three tabs 32 defining two slots 34 therebetween. Such a configuration is similar to that of conventional asphalt-based roofing shingles, and illustrates that the roofing member of the present invention can be made in diverse configurations and sizes as desired for particular applications, and to emphasize that it is not intended to limit the present invention to any particular configuration or size.

Although the synthetic member of the present invention has been described herein primarily as a synthetic slate roofing member, it should be understood that it is not intended to limit the invention to such application. For example, the synthetic member of the present invention can also be designed to duplicate the appearance of other roofing materials such as, for example, clay tiles. Also, it is not intended to limit the invention to use in roofing applications. Synthetic members of the present invention can also be used as a siding for a building, a floor, in landscaping and in other applications.

Accordingly, while what has been described herein constitutes presently preferred embodiments, it should be recognized that the invention could take numerous other forms. It should, therefore, be understood that the invention should be limited only insofar as is required by the scope of the following claims.

We claim:

1. A synthetic slate roofing member adapted to be laid on a roof structure, said synthetic slate roofing member comprising:

a solid molded body composed of solid surfacing material having one or more additives or fillers incorporated therein for enhancing properties of said body as a roofing member, said solid surfacing material comprising a material which is cast or extruded, colored throughout and about 98 percent or more de-aired and which comprises a resin selected from the group consisting of polyester, acrylic or a combination thereof, and an inert filler which functions as an extender for the resin and which renders the resin fire-retardant, said solid molded body having a textured front face formed thereon which resembles the appearance of natural slate, including edges whose thickness decreases in a stepwise fashion in the manner of natural slate, and a means for laying said solid molded body on said roof structure, said one or more additives or fillers including a weight-reducing agent incorporated in said solid surfacing material to reduce the weight of said solid molded body, and an inhibitor incorporated in said solid surfacing material to increase the resiliency of said solid molded body.

2. The roofing member of claim 1 wherein said weight-reducing agent comprises a plurality of hollow microspheres in an amount sufficient to reduce the weight of said member to be approximately 30 percent less than the weight of natural slate.

3. The roofing member of claim 1 wherein said one or more additives or fillers includes a colorant incorporated in said solid surfacing material to provide said solid molded body with a desired color.

4. The roofing member of claim 1 wherein said solid molded body is of generally rectangular shape, and wherein said laying means includes a plurality of holes extending therethrough for receipt of mounting nails for laying said solid molded body onto said roof structure.

5. The roofing member of claim 1 wherein said solid molded body comprises a generally rectangular-shaped body, and wherein said laying means includes a plurality of tabs formed on said solid molded body for mounting said solid molded body onto said roof structure.

6. The roofing member of claim 1 wherein said inhibitor comprises toluhydroquinone.

7. The roofing member of claim 2 wherein said molded body comprises about 40 percent by weight of polyester resin, about 50 percent by weight of aluminum trihydrate and about 10 percent by weight of hollow microspheres.

8. A synthetic slate roofing member comprising:

a solid molded body formed of solid surfacing material, said solid surfacing material comprising a material which is cast or extruded, colored throughout and about 98 percent or more de-aired and which comprises a polyester resin, and aluminum trihydrate as an inert filler which functions as an extender for the resin and which renders the resin fire-retardant, said solid molded body being of generally rectangular shape and having a textured front surface formed thereon which resembles the appearance of natural slate including edges whose thickness decreases in a stepwise fashion in the manner of natural slate, and a rear surface, said solid molded body further including:

a weight-reducing agent incorporated in said solid surfacing material to reduce the weight of said solid molded body, and an inhibitor incorporated in said solid surfacing material to increase the resiliency of said solid molded body, said solid molded body comprising about 40 percent by weight of polyester resin, about 50 percent by weight of aluminum trihydrate and about 10 percent by weight of weight-reducing agent.

9. The synthetic slate roofing member of claim 8 and further including a plurality of holes extending through said solid molded body from said front surface to said rear surface for receiving mounting nails for laying said solid molded body onto a roof structure.

10. The synthetic slate roofing member of claim 8 wherein said weight-reducing agent comprises a plurality of hollow microspheres in an amount sufficient to reduce the weight of said molded body to be approximately 30 percent less than the weight of natural slate, and wherein said inhibitor comprises toluhydroquinone.

* * * * *